United States Patent [19]

Kobayashi et al.

[11] Patent Number: 4,932,380

[45] Date of Patent: Jun. 12, 1990

[54] FUEL INJECTION CONTROLLER FOR AN INTERNAL-COMBUSTION ENGINE

[75] Inventors: Akio Kobayashi; Sumitaka Ogawa; Takashi Kawachi, all of Saitama, Japan

[73] Assignee: Honda Giken Kogyo Kabushiki Kaisha, Tokyo, Japan

[21] Appl. No.: 264,483

[22] Filed: Oct. 28, 1988

[30] Foreign Application Priority Data

Oct. 28, 1987 [JP] Japan ..... 62-272817
Nov. 13, 1987 [JP] Japan ..... 62-287028

[51] Int. Cl.[5] ..... F02D 41/10

[52] U.S. Cl. ..... 123/478; 123/492; 123/493

[58] Field of Search ..... 123/492, 478, 493; 364/431.07, 431.05, 431.09

[56] References Cited

U.S. PATENT DOCUMENTS 4,508,086 4/1985 Ito et al. ..... 123/492
4,513,722 4/1985 Hasagawa ..... 123/492
4,513,723 4/1985 Ishikawa et al. ..... 123/492
4,527,529 7/1985 Suzuki et al. ..... 123/492
4,573,443 3/1986 Watanabe et al. ..... 123/492
4,586,479 5/1986 Isomura et al. ..... 123/492
4,667,631 5/1987 Kinugasa ..... 123/492
4,753,210 6/1988 Fujimoto et al. ..... 123/492

*Primary Examiner*—Raymond A. Nelli
*Attorney, Agent, or Firm*—Lyon & Lyon

[57] ABSTRACT

A fuel injection controller for an internal combustion engine includes a control pulse generator which generates a pulse with each rotation of the crankshaft. An operating condition discriminator determines the operating condition of the engine. An electronic control unit changes from sequential fuel injection to simultaneous fuel injection without degradation of engine performance. An ignition controller has first, and third pulse generators generating pulses with rotation of the crankshaft and camshaft, respectively, and a second pulse generator pulsing at a phase angle with respect to the crankshaft. An ignition timer controls ignition timing based on the pulses from the first and second pulse generators, and a fuel injection timer controls fuel injection based on the pulses from the first and third pulse generators.

5 Claims, 11 Drawing Sheets

FUEL INJECTION CONTROLLER FOR AN INTERNAL-COMBUSTION ENGINE

BACKGROUND OF THE INVENTION

The present invention relates to a fuel injection controller for an internal-combustion engine. More particularly, the invention relates to a fuel injection controller capable of changing over the operating mode of the fuel injection system of a multicylinder internal combustion engine between a sequential fuel injection mode in which fuel is injected sequentially to the cylinders, and a simultaneous, group fuel injection mode in which fuel is injected simultaneously to the cylinders of each of two cylinder groups.

A known sequential fuel injection system for a multicylinder engine injects fuel in a sequential fuel injection mode. In this mode, fuel is injected in synchronism with TDC (top dead center) pulses. Each of these pulses indicate the top dead center corresponding to the start of an intake or suction stroke. The fuel is injected sequentially to the respective cylinders corresponding to the TDC pulses. A known simultaneous fuel injection system for a multicylinder engine injects fuel at a predetermined phase simultaneously into a plurality of cylinders while the engine is operating under high-load and high-speed operating conditions, where the fuel injection time interval is longer than the period of TDC pulses.

The known sequential fuel injection system delivers fuel efficiently to the cylinders, while the known simultaneous fuel injection system delivers fuel at a high rate sufficient for high-load and high-speed operation of the engine.

A simultaneous group fuel injection system for injecting fuel simultaneously into the cylinders of each of two cylinder groups is also known in the art. Japanese Patent Publication No. 47-38328 discloses a fuel injection controller which employs the simultaneous group fuel injection mode and sequential fuel injection mode selectively, depending on the operating condition of the engine to improve the performance of the engine.

However, problems arise in delivering fuel properly to the cylinders of the engine when the sequential fuel injection mode and the simultaneous group fuel injection mode are employed (selectively according to the operating condition of the engine) by directly changing the fuel injection mode from the sequential fuel injection mode to the simultaneous group fuel injection mode or vice versa.

One example is that the fuel injection mode is changed from the sequential fuel injection mode to the simultaneous group fuel injection mode immediately before a TDC pulse is generated for one of the cylinders at the start of the suction stroke. Since a time interval corresponding to one fuel injection cycle has elapsed from the preceding fuel injection for this cylinder, it is possible, depending on the timing of simultaneous group fuel injection, that no fuel is delivered to this cylinder for a time interval corresponding to two fuel injection cycles. To obviate such a possibility, the foregoing known fuel injection controller adds additional pulses to a fuel injection valve driving pulse signal. Alternatively, the pulse duration of the fuel injection valve driving pulse signal is extended to deliver a predetermined quantity of additional fuel in changing the fuel injection mode from the sequential fuel injection mode to the simultaneous group fuel injection mode.

However, such compensation measures require a special circuit for generating additional pulses or for increasing the pulse duration, which makes the configuration of the fuel injection controller complicated. Hence such known techniques are generally not practical.

The present invention also relates to an internal-combustion engine controller comprising fuel injection timing means and ignition timing means as components which function on the basis of signals representing the crank angles or instantaneous crank positions of an internal-combustion engine.

Generally, fuel injection timing and ignition timing of a multicylinder internal-combustion engine having a fuel injection device are controlled electrically by a controller. In the engine, a fuel injection angle for each cylinder corresponds to a suction or intake valve opening angle for the same cylinder. That is, in controlling fuel injection timing, the top dead center (TDC) of a suction stroke of each cylinder is detected and the fuel injection device is actuated at the TDC. On the other hand, an ignition angle is set to a crank angle before the TDC of a compression stroke. This crank angle must be set accurately according to the operating condition of the engine. Also, fuel injection timing must be controlled more accurately than ignition timing, because the advance ignition position and the retard ignition position relative to the TDC of a compression stroke has a direct effect on the performance of the engine.

Thus, in the engine, the start of fuel injection timing control and the start of ignition timing control are different from each other.

Accordingly, the conventional internal-combustion engine controller comprises TDC detecting means for generating a TDC pulse signal (hereinafter TDC signal) every time the piston of each cylinder arrives at a position corresponding to a crank angle before the TDC of the suction stroke by a predetermined angle (for example, in a six cylinder engine, every time the crankshaft turns through an angle of 120°). Cylinder discriminating means are provided for generating a cylinder pulse signal CYL signal when a crank corresponding to a specified cylinder is at the TDC of a suction stroke, to carry out fuel injection cycles for the plurality of cylinders in a predetermined order by discriminating each cylinder corresponding to each TDC signal. Fuel injection timing operation is controlled on the basis of the output signals of the TDC detecting means and the cylinder discriminating means, namely, the TDC signal and the CYL signal. On the other hand, to enable accurate ignition timing control as mentioned above, another conventional internal-combustion engine controller comprises first pulse signal generating means for generating a pulse signal when the crank of each cylinder is at the TDC of a compression stroke, and second pulse signal generating means for generating a pulse signal every time the crankshaft turns through a predetermined angle (for example, 30°) to divide the interval between the TDCs of the cylinders into equal angular intervals (a predetermined number of stages S). This conventional internal-combustion engine controller determines a fixed stage S in which ignition is started from the output signals of the two pulse signal generating means for accurate ignition timing control suitable for the operating condition of the engine.

To enable such accurate ignition timing control, Japanese Patent Application No. 60-31628 proposes an ignition timing controller comprising: projections arranged at regular angular intervals (for example, a crank angle of 30°) on the circumference of a rotary member which rotates together with the crankshaft, excluding at least a portion of the circumference of the rotary member corresponding to the two equal angular intervals; first pulse signal generating means for generating a pulse signal every time each of the projections pass by a fixed position; and second pulse signal generating means for generating pulse signals having a predetermined phase difference relative to the output pulse signals of the first pulse signal generating means. This known ignition timing controller discriminates, on the basis of the output signals of the first and second pulse signal generating means, a cylinder corresponding to a crank at the TDC of a compression stroke and divides the angular interval between two TDCs into a plurality of stages S to achieve accurate ignition timing control on the basis of the stages S.

Recently, it has become desirable to make such an internal-combustion engine controller into a compact and simple configuration to reduce the manufacturing cost. However, the foregoing conventional controller needs at least four crank angle detecting means for fuel injection timing control and ignition timing control. Hence the conventional controller is unable to be made in a compact and simple configuration.

SUMMARY OF THE INVENTION

To this end, a fuel injection controller for an internal-combustion engine having a plurality of cylinders divided into two cylinder groups includes a plurality of fuel injection units respectively for the plurality of cylinders, control pulse generating means for generating a pulse every time the crankshaft turns through a predetermined angle, and fuel injection mode changeover means for changing over the fuel injection mode of the fuel injection units between a sequential fuel injection mode and simultaneous group fuel injection mode. In the sequential mode, the fuel injection units inject fuel sequentially into the corresponding cylinders in synchronism with the control pulses. With simultaneous group fuel injection mode, the fuel injection units inject fuel simultaneously into the corresponding cylinders in synchronism with the control pulses. The fuel injection controller comprises operating condition discriminating means for determining if the internal-combustion engine is operating in a predetermined operating condition when a control pulse indicating the specified reference cylinder among the cylinders is generated. The fuel injection mode changeover means makes the fuel injection units for one cylinder group including the specified reference cylinder of the two cylinder groups inject fuel simultaneously upon the decision of the operating condition discriminating means that the internal-combustion is in a predetermined operating condition. Then the fuel injection units for the other cylinder group inject fuel simultaneously in synchronism with a subsequent control pulse.

To this end, the present invention also provides an internal-combustion engine controller comprising a plurality of projections arranged at equal angular intervals on the circumference of the crankshaft of an internal-combustion engine having a fuel injection device. At least a portion of the circumference of the crankshaft corresponding to the two equal angular intervals of the projections is cut out or excluded. A first pulse generator is provided for generating a pulse signal every time each projection passes by a fixed position as the crankshaft rotates. A second pulse generator is included for generating a pulse signal having a phase angle relative to the pulse signal generated by the first pulse generator, disposed at a circumferential distance from the first pulse generator. A single projection is provided on the circumference of a second shaft which rotates at a rotating speed equal to half the rotating speed of the crankshaft. A third pulse generator generates a pulse signal every time the projection provided on the circumference of the second shaft passes by a fixed position. An ignition timer controls ignition timing for the engine on the basis of the pulse signals generated by the first and second pulse generators. A fuel injection timer controls the fuel injecting device for appropriate fuel injection on the basis of the pulse signals generated by the first and third pulse generators.

Accordingly, it is an object of the present invention to provide a fuel injection controller capable of smoothly changing over the fuel injection mode through a simple procedure without requiring any special signal generating circuit.

It is also an object of the invention to provide an internal-combustion engine controller having a simple crank angle detecting system, which is compact and capable of being manufactured at low cost. Other and further objects and features will appear hereinafter.

BRIEF DESCRIPTION OF THE DRAWINGS

In the drawings, wherein similar reference characters denote similar elements throughout the several views.

DETAILED DESCRIPTION OF THE PREFERRED EMBODIMENTS

Figure 1:
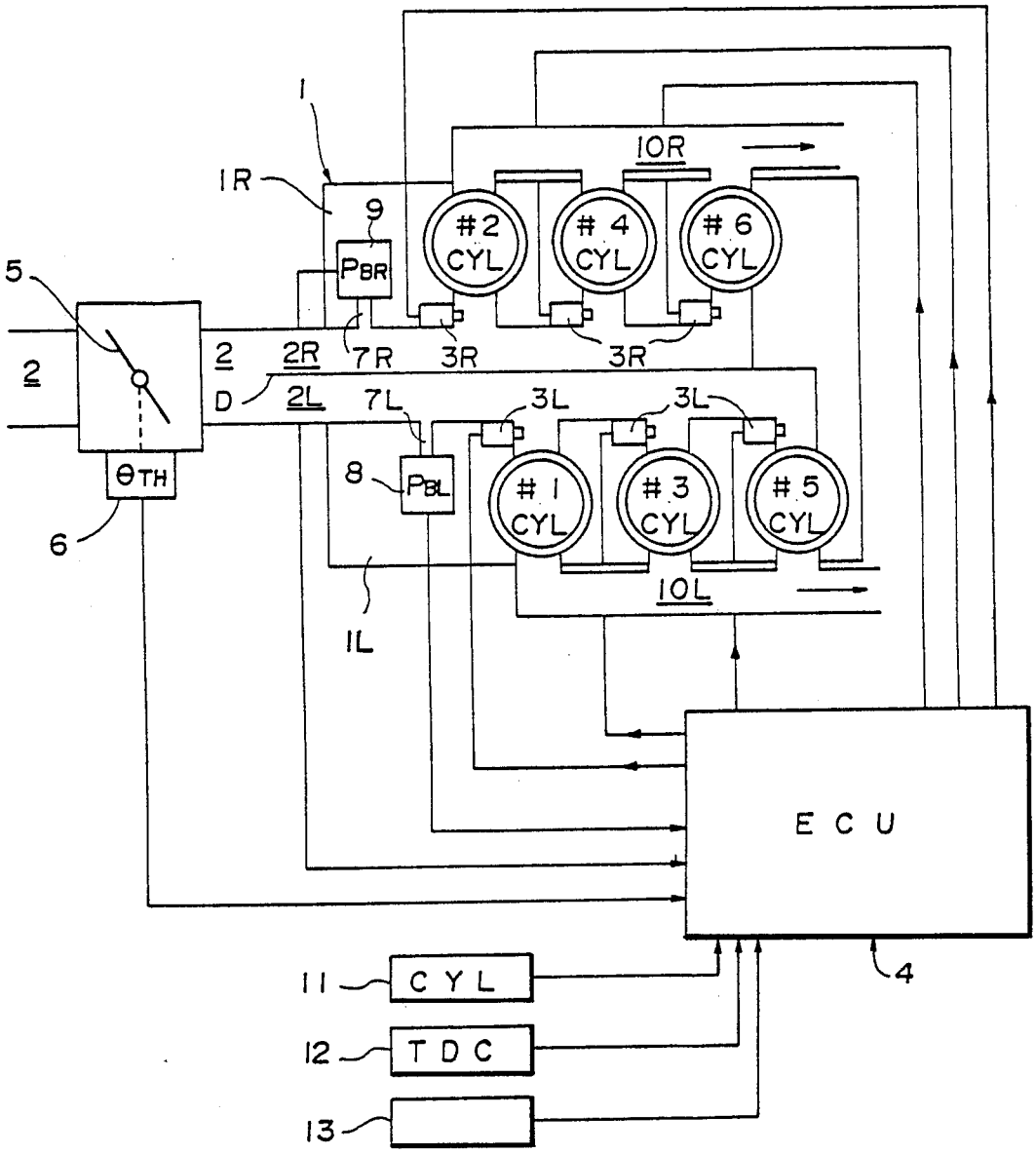
FIG. 1 is a schematic illustration of the general configuration of a fuel injection controller in a preferred embodiment of invention as applied to an internal-combustion engine.

In FIG. 1, a six-cylinder internal-combustion engine 1 has cylinders CYL1 to CYL6, which are divided into two cylinder groups. One cylinder group comprises the three cylinders CYL1, CYL3 and CYL5 arranged in a left bank 1L, and the other cylinder group comprises the three cylinders CYL2, CYL4 and CYL6 arranged in a right bank 1R. The respective intake or suction ports of the cylinders CYL1, CYL3 and CYL5 in the left bank 1L are connected to a first intake manifold 2L branched from an intake pipe 2. Fuel injection valves 3L (INJ1, INJ3 and INJ5) are provided on the first intake manifold 2L before or upstream of the suction or intake valves, (not shown) of the cylinders CYL1, CYL3 and CYL5, respectively.

The fuel injection valves 3L and 3R (INJ1 to INJ6) are connected to a fuel injection pump (not shown) of the cylinders CYL2, CYL4 and CYL6, respectively.

On the other hand, the respective suction ports of the cylinders CYL2, CYL4 and CYL6 in the right bank 1R are connected to a second intake manifold 2R branched from the intake pipe 2. Fuel injection valves are 3R (INJ2, INJ4 and INJ6) are provided on the second intake manifold 2R before the intake valves (not shown) of the cylinder CYL2, CYL4, and CYL6, respectively. The fuel injection valves 3L and 3R (INJ1–INJ6) are connected electrically to an electronic control unit (hereinafter abbreviated to "ECU") 4, which provides driving signals for controlling the fuel injection period of each fuel injection valve.

A throttle valve 5 is provided at a position before the junction D of the intake manifolds 2R and 2L on the intake pipe 2. A valve position sensor 6 detects the valve position $\theta_{TH}$ of throttle valve 5 and electrically provides a valve position signal representing the valve position to the ECU 4. An L-side absolute pressure sensor (hereinafter referred to as "$P_{BL}$ sensor") 8 and an R-side absolute pressure sensor (hereinafter referred to as "$P_{BR}$ sensor") 9 are connected by branch pipes 7L and 7R to the first intake manifold 2L and the second intake manifold 2R, respectively. The $P_{BL}$ sensor 8 and $P_{BR}$ sensor 9 electrically provide absolute pressure signals respectively representing absolute pressures in the intake manifolds 2L and 2R to the ECU4.

The exhaust ports of the cylinders in the left bank 1L, and those of the cylinders in the right bank 1R are connected to an exhaust manifold 10L and an exhaust manifold 10R, respectively. The extremities of the exhaust manifolds 10L and 10R are joined to an exhaust pipe (not shown).

A cylinder discriminating sensor 11 (CYL sensor) and a phase sensor (TDC sensor) are disposed near the cam shaft or the crankshaft (not shown). The CYL sensor 11 provides a cylinder discriminating signal (CYL pulse signal) at a fixed crank angle of one specified cylinder among the cylinders. The TDC sensor 12 provides a control signal (hereinafter referred to as TDC pulse signal) at a crank angle a fixed angle before the TDC of each cylinder with every rotation of the crankshaft through an angle of 120°. The CYL pulse signal and the TDC pulse signal are provided to the ECU 4.

A parameter sensor 13 for detecting parameters indicating the operation condition of the engine, such as the atmospheric pressure and engine temperature, provides signals representing the operating condition of the engine to the ECU 4.

The ECU 4 determines the operating condition of the engine on the basis of the output signals of those sensors, determines fuel injection periods $T_{OUTL}$ and $T_{OUTR}$ according to the operating condition of the engine, and controls the fuel injection valves INJ1 to INJ6 for fuel injection in synchronism with the TDC pulse signal.

Figure 4:
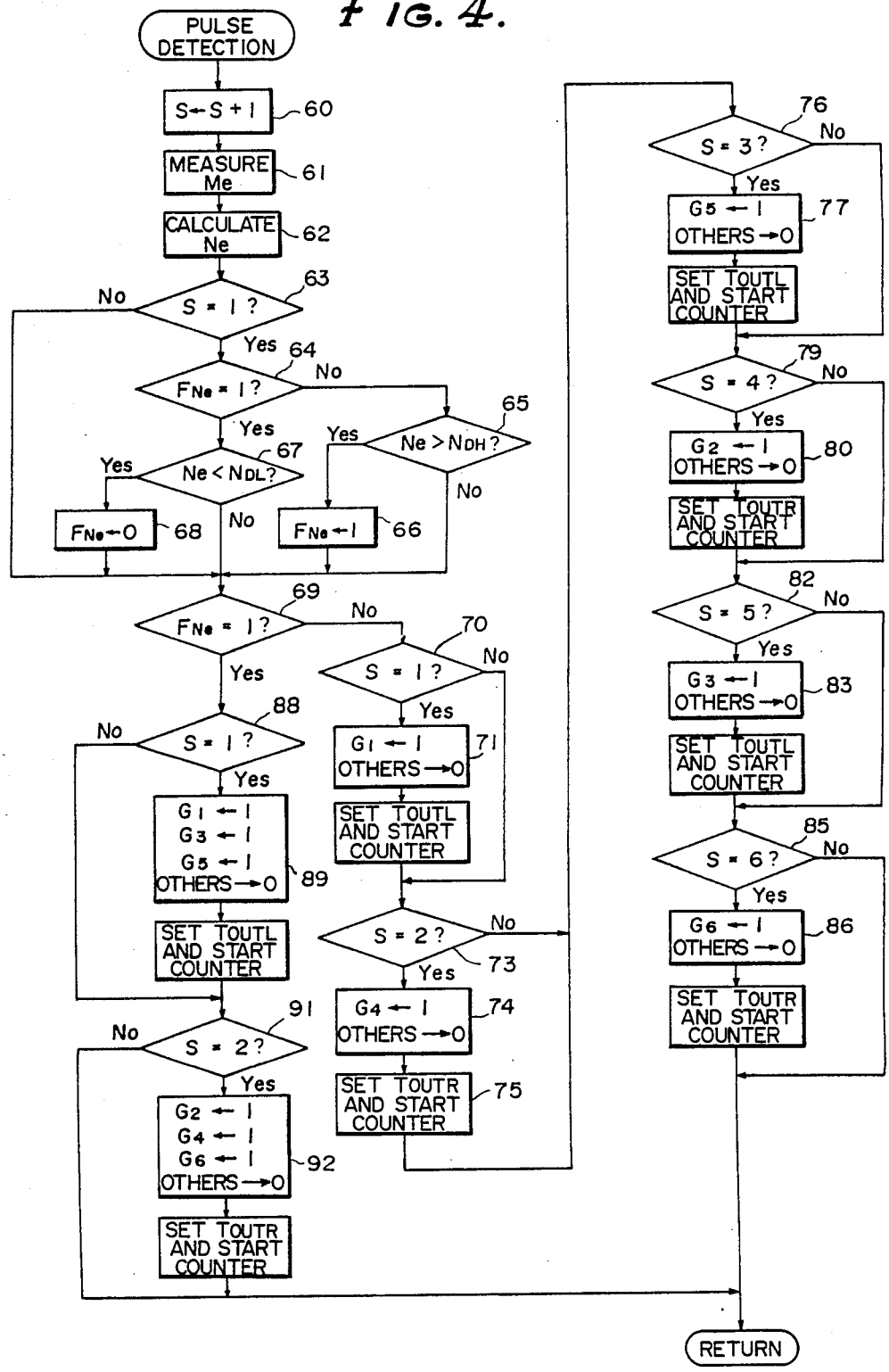
FIG. 4 is a flow chart of the steps of operation the fuel injection controller for changing over the fuel injection mode in accordance with the operating condition of the engine.

The ECU 4 includes fuel injection mode changeover means which carriers out a program shown in FIG. 4 to change the fuel injection mode according to the operating condition of the engine. The ECU 4 also includes operating condition discriminating means which determines whether the operating condition of the engine coincides with a predetermined operating condition.

Figure 2:
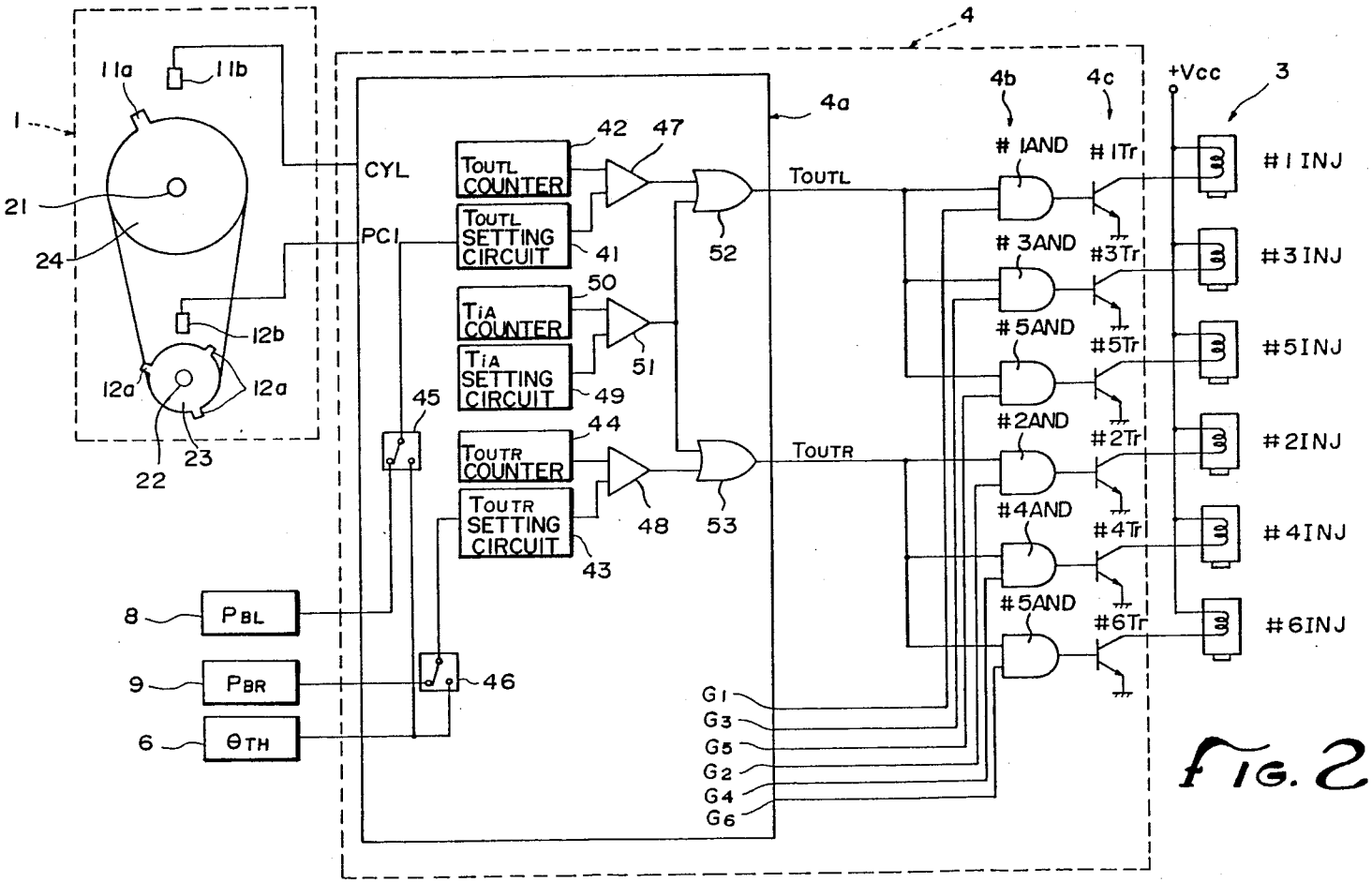
FIG. 2 is a schematic block diagram of the details of the TDC sensor, the CYL sensor and the ECU shown FIG. 1.

FIG. 2 further illustrates the structure and operation of the CYL sensor 11, the TDC sensor 12, and ECU 4 of the fuel injection controller shown in FIG. 1. In FIG. 2, the six-cylinder internal-combustion engine 1 is represented by the cam shaft 21 and the crankshaft 22 therein enclosed by broken lines. The cam shaft 21 is provided with a radial projection 11*a* at a fixed position on the circumference thereof. The crankshaft 22 is provided, for example, with three radial projections 12*a* arranged at regular angular intervals on the outer circumference of a rotor 23. The projections 11*a* and 12*a* project radially outwardly from the corresponding camshaft or crankshaft circumference. A pickup 11*b* is disposed near the circular part of the radial projection 11*a*. The radial projection 11*a* and the pickup 11*b* comprise the CYL sensor 11. Similarly, a pickup 12*b* is disposed near the circular path of the radial projections 12*a*. The radial projections 12*a* and the 12*b* form the TDC sensor 12. The pickup 11*a* passes by the pickup 11*b*. The pickup 12*b* generates a TDC pulse signal every time each radial projection 12*a* passes by the pickup 12*b*.

The ECU 4 essentially comprises a fuel injecting point setting circuit 4*a* which calculates fuel injection periods $T_{OUTL}$ and $T_{OUTR}$ meeting the operating condition of the engine respectively for the cylinders in the left bank 1L (L bank cylinders) and the cylinders in the right bank 1R (R bank cylinders). Fuel injecting point setting circuit 4*a* also provides driving signals corresponding to the fuel injection periods $T_{OUTL}$ and $T_{OUTR}$ in synchronism with the CYL pulse signal and the TDC pulse signal. An AND gate array 4*b* comprises six AND gates AND1 to AND6, and allows the driving signal to be applied only to one fuel injection valve among the fuel injection valves INJ1 to INJ6. A transistor array 4*c* comprises six driving transistors Tr1 to Tr6 incorporated into the fuel injection valves INJ1 to INJ6, respectively. The driving signal is applied to one input terminal of each of the AND gates AND1 to AND6. Signals provided by the six injection gates G1 to G6 of the fuel injecting point setting circuit 4*a* are applied to the other input terminals of the AND gates AND1 to AND6, respectively.

The fuel injecting point setting circuit 4*a* comprises a $T_{OUTL}$ setting circuit 41 for setting the fuel injection period $T_{OUTL}$ for the fuel injection valves INJ1, INJ3 and INJ5 of the L bank cylinders; a $T_{OUTL}$ counter 42; a $T_{OUTR}$ setting circuit 43 for setting the fuel injection period $T_{OUTR}$ for the fuel injection valves INJ2, INJ4 and INJ6 of the R bank cylinders every time a pulse of the TDC pulse signal for the R bank cylinders is generated; and a $T_{OUTR}$ counter 44.

The $T_{OUTL}$ setting circuit 41 is connected via a transfer switch 45 to the $P_{BL}$ sensor 8 and the $\theta_{TH}$ sensor 6. The $T_{OUTR}$ setting circuit 43 is connected via a transfer switch 46 to $P_{BR}$ sensor and the $P_{BR}$ sensor 6. The $T_{OUTL}$ setting circuit 41 and the $T_{OUTR}$ setting circuit 43 set the fuel injection periods $T_{OUTR}$ and $T_{OUTR}$, respectively, on the basis of either the internal absolute pressures $P_{BL}$ and $P_{BR}$ of the intake manifolds 2L and 2R or the throttle valve position $\theta_{TH}$, and the output signals of the parameter sensor 13. Signals representing the fuel injection periods $T_{OUTL}$ and $T_{OUTR}$ are applied to one of the input terminals of a first comparator 47 and to one of the input terminals of a second comparator 48, respectively.

The $T_{OUTL}$ counter 42 and the $T_{OUTR}$ counter 44 start simultaneously with the setting of the fuel injection periods $T_{OUTL}$ and $T_{OUTR}$. The output signals of the counters 42 and 44 are applied to the other input terminal of the first comparator 47 and to the other input terminal of the second comparator 48, respectively.

The first comparator 47 continues to provide an H-level $T_{OUTL}$ signal until the count of the $T_{OUTL}$ counter 42 coincides with the fuel injection period set by the $T_{OUTL}$ setting circuit 41, namely, for a time interval of $T_{OUTL}$ from the time when a TDC pulse signal indicating the start of the suction or intake stroke of the L bank cylinders is provided. The second comparator 48 continues to provide a H-level $T_{OUTR}$ signal until the count of the $T_{OUTR}$ counter 43 coincides with the fuel injection period set by the $T_{OUTR}$ setting circuit 42, namely, for a time interval of $T_{OUTR}$ from the time when a TDC pulse signal indicating the start of the intake stroke of the R bank cylinders is provided.

The fuel injecting point setting circuit 4a further comprises a $Ti_A$ counter 50, a third comparator 51 and a $Ti_A$ setting circuit 49, which is of the same construction as the $T_{OUTL}$ setting circuit 41 and the $T_{OUTR}$ setting circuit 43. The $Ti_A$ setting circuit 49 functions asynchronously with the TDC pulse signal to set an asynchronous acceleration time increment $Ti_A$ on the basis of an acceleration parameter, such as a throttle valve position, indicating the accelerating mode of the engine. The $Ti_A$ counter 50 starts upon the setting of the acceleration time increment $Ti_A$. The $Ti_A$ setting circuit 49 applies a signal representing the acceleration time increment $Ti_A$ to one of the input terminals of the third comparator 51, and the $Ti_A$ counter 50 applies a signal representing the count thereof to the other input terminal of the third comparator 51. The third comparator 51 continues to provide a H-level $T_{OUTA}$ signal for a time interval $Ti_A$ independently of the TDC pulse signal while the engine is accelerating.

The output signals of the first comparator 47 and the second comparator 51 are applied to the input terminals of a first OR gate 52. The output signal of the first OR gate 52 is a corrected fuel injection period $T_{OUTL}$ corrected for acceleration for the L bank cylinders. The output terminal of the first OR circuit 52 is connected to the AND gates AND1, AND3 and AND5 for the L bank cylinders to apply a driving signal corresponding to the corrected fuel injection period $T_{OUTL}$ only to the AND gates AND1, AND3 and AND5 for the L bank cylinders.

Similarly, the output signals of the second comparator 48 and the comparator 51 are applied to the input terminals of a second OR gate 53. The output signal of the second OR gate 53 is a corrected fuel injection period $T_{OUTL}$ corrected for acceleration for the R bank cylinders. The output terminal of the second OR gate 53 is connected to the AND gates AND2, AND4 and AND6 for the R bank cylinders to apply a driving signal corresponding to the corrected $T_{OUTR}$ only to the AND gates AND2, AND4 and AND6 for the R bank cylinders.

The output signals of the injection gates G1 to G6 are applied to the input terminals of the AND gates AND1 to AND6, respectively. The injection gates G1 to G6 provide H-level output signals or L-level output signals depending on the determination of whether a cylinder is in a position corresponding to the TDC pulse signal among the cylinders CYL1 to CYL6 or on the decision of the bank, namely, the L bank or the R bank, to which the cylinder indicated by the TDC pulse signal belongs.

Accordingly, when both the driving signals corresponding to the fuel injection periods $T_{OUTL}$ and $T_{OUTR}$ are provided by the OR gates 52 and 53, and the output signal of the injection gate G1 to G6 are H-level signals, the fuel injection valves corresponding to the injection gates G1 to G6 are opened for the fuel injection periods $T_{OUTL}$ and $T_{OUTR}$, respectively.

Figure 3:
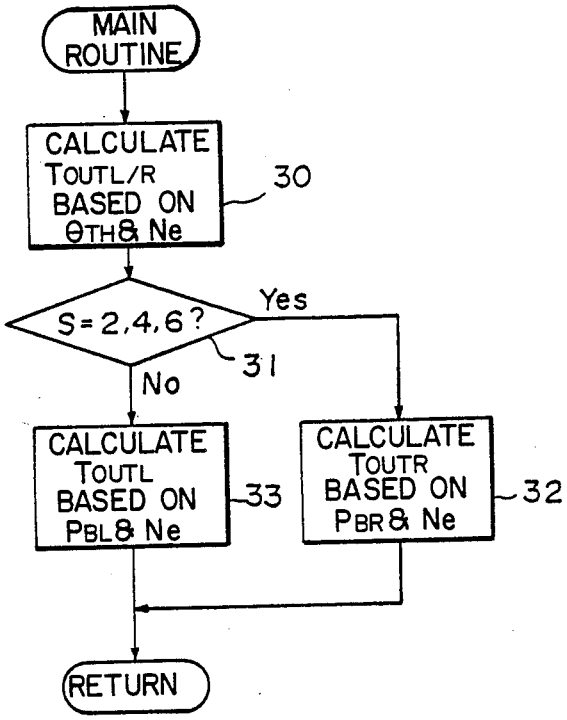
FIG. 3 is a flow chart of a main routine for determining fuel injection periods $T_{OUTL}$ and $T_{OUTR}$.

The operation of the present fuel injection controller is shown in FIG. 3, a block diagram of a main routine for calculating the fuel injection period $T_{OUTL}$ for the fuel injection valves INJ1, INJ3 and INJ5 for the L bank cylinders and the fuel injection period $T_{OUTR}$ for the fuel injection valves INJ2, INJ4 and INJ6 for the R bank cylinders. These calculations are performed on the basis of a cylinder discriminating value S, an engine speed Ne, an absolute pressure within the intake manifold 2L, an absolute pressure within the intake manifold 2R, and a throttle valve position $\theta_{TH}$. To calculate a common fuel injection period $T_{OUTL/R}$ to be applied for controlling the fuel injection periods $T_{OUTL}$ and $T_{OUTR}$, the throttle valve position $\theta_{TH}$ is used instead of the absolute pressures within the intake manifold, by switching the transfer switches 45 and 46.

Referring to FIG. 3, the common fuel injection period $T_{OUTL}$/R is calculated on the basis of the throttle valve position $\theta_{TH}$ and the engine speed Ne in Step 30. The engine speed Ne is the reciprocal of the time interval Me between the adjacent TDC pulse signals, calculated in Steps 61 and 62, as described below.

In Step 31, the cylinder discriminating value S, (which is obtained in Step 60 below) indicating the cylinder is at the start of the intake stroke at a moment when a TDC pulse signal is provided, is tested to determine if the cylinder discriminating value S corresponds to the cylinder number 2, 4 or 6 of one of the R bank cylinders CYL2, CYL4 and CYL6. When the result of the test if affirmative (YES), namely, when the cylinder of the R bank cylinders is at the start of an intake stroke when a TDC pulse signal is generated, a fuel injection period $T_{OUTR}$ for the R bank cylinders is calculated in Step 32 on the basis of the absolute pressure $P_{BR}$ and the engine speed Ne, and then the main routine is ended. On the other hand, when the decision in Step 31 is negative (NO) namely, when the cylinder at the start of intake cycle when TDC pulse signal is generated is one of the L bank cylinders, a fuel injection period $T_{OUTL}$ is calculated in Step 33 on the basis of the absolute pressure $P_{BL}$ and the engine speed Ne, and then the main routine is ended.

Figure 6:
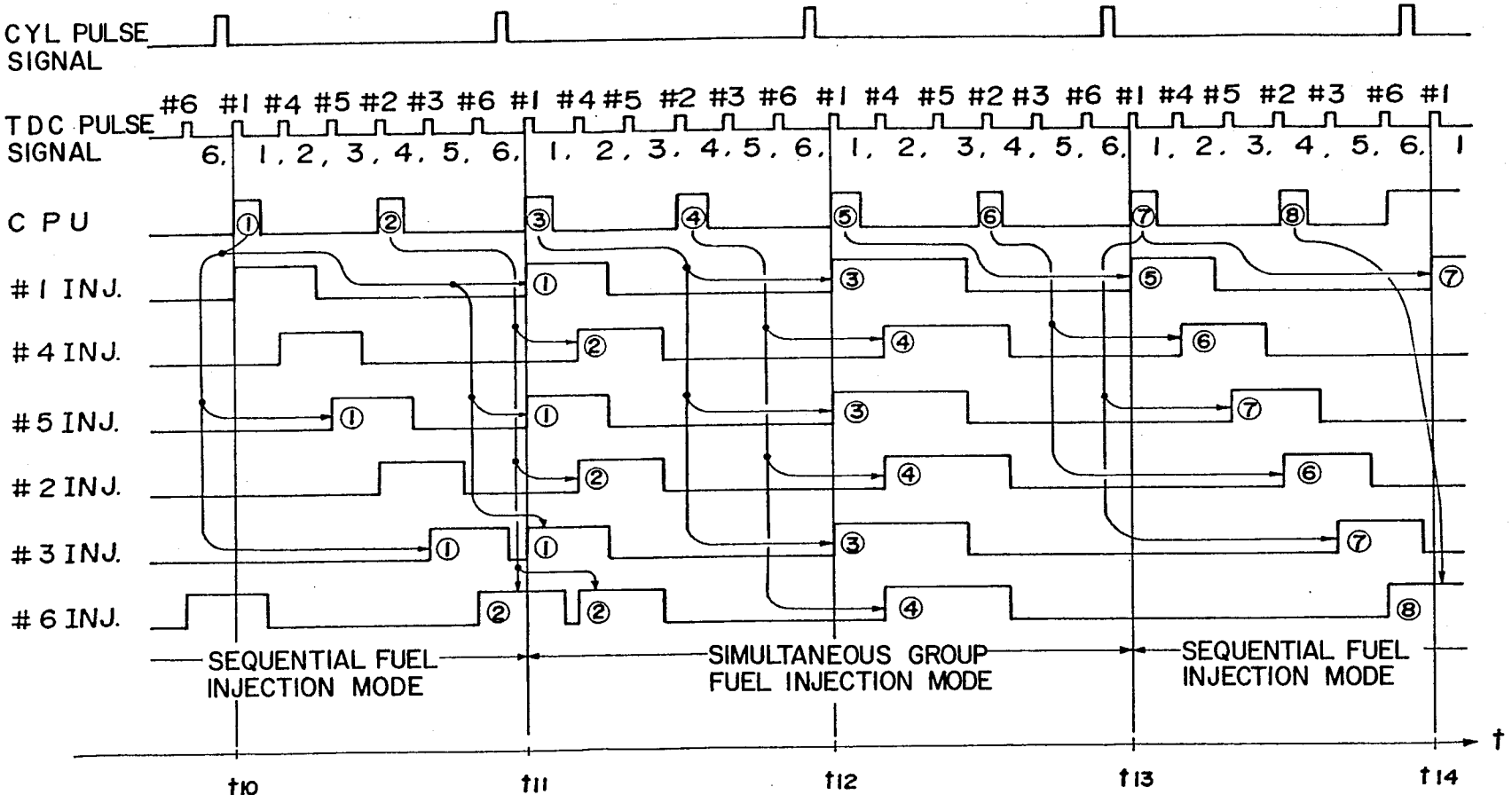
FIG. 6 is a timing chart illustrating the relation between TDC pulse signals and the operation of the fuel injection valves for the cylinders.

As shown in FIG. 6, the main routine calculates the fuel injection period $T_{OUTL}$ only when a TDC pulse signal indicating the specified reference cylinder among the L bank cylinders, for example, the cylinder CYL1, is generated. In a similar manner, the main routine calculates the fuel injection period $T_{OUTR}$ only when a TDC pulse signal is generated indicating the specified reference cylinder among the R bank cylinders, for example, the cylinder CYL4. The fuel injection periods $T_{OUTL}$ and $T_{OUTR}$ may be used for fuel injection at the next TDC pulse signal.

The procedure for operating the fuel injection valves INJ1 to INJ6 according to the fuel injection periods $T_{OUTL}$ and $T_{OUTR}$ and the gate signals G1 to G6 is described hereinafter with reference to FIG. 4 which shows a flow chart of a control routine. When the engine is operating in a specified operating condition, the fuel injection periods $T_{OUTL}$ and $T_{OUTL}$ are the same as the common fuel injection period $T_{OUTL/R}$ determined on the basis of the throttle valve position $\theta_{TH}$. The description of the procedure for setting the fuel injection periods $T_{OUTL}$ and $T_{OUTR}$ to the common fuel injection period $T_{OUTL}$/R will be omitted.

Figure 5:
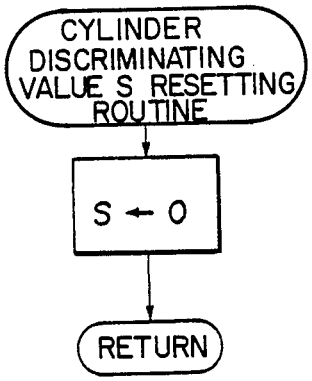
FIG. 5 is a flow chart showing a routine for resetting a cylinder discriminating value S every time a CYL signal is generated.

Referring to FIG. 4, upon the detection of a TDC pulse signal generated by the TDC sensor 12, the cylinder discriminating value S is incremented by 1 (one) in Step 60 to provide a new cylinder discriminating value S+1. The cylinder discriminating value S is reset to zero by executing a control routine shown in FIG. 5 every time a CYL pulse signal is generated. Accordingly, as shown in FIG. 6, the cylinder discriminating value S=1 is generated when a first TDC pulse signal after a CYL pulse signal, and the cylinder discriminating value S is incremented by 1 every time a TDC pulse signal is generated until the next CYL pulse signal is generated. Consequently, the cylinder discriminating value S starts increasing from the moment when a TDC pulse signal is generated from 1 to 6. The cylinder discriminating values 1, 2, 3, 4, 5 and 6 correspond respectively to the fuel injection valves INJ1, INJ4, INJ5, INJ2, INJ3 and INJ6.

The time interval Me between the successive TDC pulse signals is measured in Step 61, and then the reciprocal of the time interval Me is calculated in Step 62 to obtain an engine speed Ne.

In Step 63, a query is made as to whether the cylinder discriminating value S set in Step 60 corresponds to a specified reference cylinder, for example, the cylinder CYL1. When response in Step 63 is affirmative (YES), Steps 64 to 68 are executed to discriminate the operating condition of the engine corresponding to the engine speed Ne.

In Step 64, a decision is made on whether an operating condition discriminating flag $F_{Ne}$, (which is 1 or 0 depending on the operating condition of the engine determined in Step 66 or 68) is 1. The operating condition discriminating flag $F_{NE}$ indicates that the engine was operating during the preceding control loop in the sequential fuel injection mode (in which fuel is injected sequentially into the cylinders every time a TDC pulse signal is generated ($F_{Ne}$=0)) or that the engine was operating during the preceding control loop in the simultaneous group fuel injection mode (in which fuel is injected simultaneously into the L bank cylinders CYL1, CYL3 and CYL5 when a TDC pulse signal indicating the specified reference cylinder, for example, the cylinder CYL1, of the L bank is generated, and then fuel is injected simultaneously into the R bank cylinders CYL2, CYL4 and CYL6 when a subsequent TDC pulse signal is generated ($F_{Ne}$=1)). The initial value of the flag $F_{Ne}$ is 0 (zero).

When the decision in Step 64 is NO, namely, when fuel was injected in the sequential fuel injection mode during the preceding fuel injecting cycle subsequent to the preceding TDC pulse signal, a decision is made in Step 65 to determine if the engine speed Ne is higher than a first reference engine speed $N_{DH}$ (for example, 3000 rpm). When the decision in Step 65 is YES, namely, when the engine speed Ne in the present control loop is higher than the first reference engine speed $N_{DH}$, even if fuel had been injected in the sequential fuel injection mode until the preceding control loop, the operating condition discriminating flag $F_{Ne}$ is set to 1 in Step 66 to inject fuel in the simultaneous group fuel injection mode from Step 69. When the decision in Step 65 is NO, the operating condition discriminating flag $F_{Ne}$ is held at 0, Step 66 is skipped, and then Step 69 and the following steps are executed.

When the decision is Step 64 is YES, namely, in case the engine has been operating in the simultaneous group fuel injection mode after the preceding TDC pulse signal, a decision is made in Step 67 on whether the engine speed Ne is lower than a second reference engine speed $N_{DL}$ (for example, 1700 rpm), which is lower than the first reference engine speed $N_{DH}$. When the decision in Step 67 is YES, namely, when the engine speed Ne in the present control loop is lower than the second reference engine speed $N_{DL}$ even if the engine had been operating in the simultaneous group fuel injection mode until the preceding control loop, the operating condition discriminating flag $F_{Ne}$ is set to 0 in Step 68 to operate the engine in the sequential fuel injection mode from Step 69.

The use of the first reference engine speed $N_{DH}$ and the second reference engine speed $N_{DL}$ which is different from the first reference engine speed $N_{DH}$ for changing the operating condition discriminating flag $F_{Ne}$ depending on the engine speed Ne gives the effect of hysteresis, which enables the fuel injection mode to be changed smoothly from the sequential fuel injection mode the simultaneous group fuel injection mode or vice versa without being affected by the variation of the engine speed.

Since the procedure for changing the operating condition discriminating flag $F_{Ne}$ (Steps 64 through 68) is executed only when the cylinder discriminating value S (for example, 1) indicates a specified reference cylinder (for example, CYL1) namely, only when the decision in Step 63 is affirmative, the fuel injection mode can be changed from the sequential mode to the simultaneous group fuel injection mode only when a TDC pulse signal indicating the specified reference cylinder (CYL1) is generated. Furthermore, Steps 88 through 90 are executed to inject fuel simultaneously into the L bank cylinders immediately after the fuel injection mode has been changed from the sequential fuel injection mode to the simultaneous group fuel injection mode (at which time S=1). Then Steps 91 through 93 are executed to inject fuel into the R bank cylinders in the simultaneous group fuel injection mode in synchronism with a subsequent TDC pulse signal (at which time S=2).

Since the $T_{OUTL}$ counter for the L bank cylinders and the $T_{OUTL}$ counter for the R bank cylinders are provided separately, simultaneous group fuel injection for the R bank cylinders can be carried out upon the generation of TDC Pulse signal subsequent to a TDC Pulse signal for initiating simultaneous group fuel injection for the L bank cylinders, even if the fuel injection 1 periods $T_{OUTL}$ and $T_{OUTR}$ overlap each other as shown in FIG. 6.

Referring again to FIG. 4, a decision is made in Step 69 on whether the operating condition discriminating flag $F_{Ne}=1$, namely, if fuel is to be injected in the simultaneous group fuel injection mode. When the decision in Step 69 is NO, the following Steps 70 through 87 are executed for sequential fuel injection. When the decision in Step 69 is YES, Steps 88 through 93 are executed for simultaneous group fuel injection.

With sequential fuel injection in Step 70, a decision is made on whether the cylinder discriminating value S is 1 indicating the cylinder CYL1, namely, if the present TDC pulse signal corresponds to the start of the suction or intake stroke of the cylinder CYL1. When the decision in Step 70 is YES, only the output G1 of the injection gate corresponding to the cylinder CYL1 is set to HIGH (=1), while the rest of the outputs G2 to G6 are set to LOW (=0) in Step 71. Then, the $T_{OUTL}$ setting circuit 41 (FIG. 2) is set for the fuel injection period $T_{OUTL}$ calculated in Step 33 (FIG. 3) and the $T_{OUTL}$ counter 42 is started in Step 72. Consequently, only the fuel injection valve INJ1 for the cylinder CYL1 is opened for the fuel injection period $T_{OUTL}$, when the cylinder discriminating value S is 1.

When the decision in Step 70 is NO, Steps 71 and 72 are skipped, and then a decision is made in Step 73 on whether the cylinder discriminating value S is 2, which indicates the cylinder CYL4. When the decision in Step 73 is YES, only the output G4 of the injection gate corresponding to the cylinder CYL4 is set to HIGH (=1), while the outputs of the rest of the injection gates are set to LOW (=0) in Step 74. Then, in Step 75, the $T_{OUTR}$ setting circuit 43 (FIG. 2) is set for the fuel injection period $T_{OUTR}$ calculated in Step 34 (FIG. 3), and the $T_{OUTR}$ counter 44 is started to open only the fuel injection valve INJ4 for the cylinder CYL4 for the fuel injection period $T_{OUTR}$.

Subsequently, the same decision as that made in Steps 70 and 73 is made in 76, 79, 82 and 85 to determine which cylinder corresponds to the cylinder discriminating value S, and then the fuel injection valve corresponding to the cylinder indicated by the cylinder discriminating value S is opened for the fuel injection period $T_{OUTL}$ or $T_{OUTR}$.

With simultaneous group fuel injection, in Step 88, a decision is made on whether the cylinder discriminating value S (for example, 1) indicates the specified reference cylinder (for example, CYL1). When the decision in Step 88 is YES, the output G2, G3 and G5 of the injection gates corresponding to the L bank cylinders CYL1, CYL3 and CYL5 are set to HIGH (=1) and the outputs of the rest of the injection gates are set to LOW (=0) in Step 89. Then, in Step 90, which is similar to the operations in Step 72, the $T_{OUTL}$ setting circuit 41 is set for the fuel injection period $T_{OUTL}$ and the $T_{OUTR}$ counter 42 is started. Consequently, all the fuel injection valves INJ1, INJ3 and INJ5 for the L bank cylinders CYL1, CYL3 and CYL5 are opened for the fuel injection period $T_{OUTL}$, when the cylinder discriminating value S indicates the cylinder CYL1.

When the decision in Step 88 is NO, the routine goes to Step 91, where it is determined whether the cylinder discriminating value S indicates the cylinder to be subjected to fuel injection is subsequent to the specified reference cylinder (CYL1). When the decision in Step 88 is YES, namely, when the present TDC pulse signal is the first TDC pulse signal subsequent to the TDC pulse signal at which the fuel injection mode was changed from the sequential fuel injection mode to the simultaneous group fuel injection mode, the outputs G2, G4 and G6 of the injection gates corresponding to the R bank cylinders CYL2, CYL4 and CY16 are set to HIGH (=1), the outputs of the rest of the injection gates are set to LOW (=0), the $T_{OUTR}$ setting circuit 43 is set for the fuel injection period $T_{OUTR}$, and the $T_{OUTR}$ counter 44 is started in Step 92. Consequently, all the fuel injection valves INJ2, INJ4 and INJ6 for the R bank cylinders CYL2, CYL4 and CYL6 are opened for the fuel injection period $T_{OUTR}$.

When both the decisions in Steps 88 and 91 are NO, namely, when the cylinder discriminating values S in the present control loop are values other than 1 and 2, no fuel injection valve is opened and the routine is ended.

Thus, fuel is injected in the simultaneous group fuel injection mode according to the foregoing procedure during a time period between time $t_{11}$ and $t_{13}$ (FIG. 6), in which only the fuel injection valves INJ1, INJ3 and INJ5 for the L bank cylinders are opened simultaneously when the TDC pulse signal indicates the specified reference cylinder (CYL1) of the L bank. On the other hand, all the fuel injection valves INJ2, INJ4 and INJ6 for the R bank cylinders are opened simultaneously for fuel injection at the moment when the TDC pulse signal subsequent to the TDC pulse signal indicating the specified reference cylinder of the L bank is generated.

Thus, the operating condition of the engine is tested to decide if the engine is operating in the predetermined operating condition (for example, if the engine speed is higher than the reference engine speed) when a TDC pulse signal indicating the specified reference cylinder is generated, and then either the sequential fuel injection mode or the simultaneous group fuel injection mode is selected immediately depending on the result of the decision. Accordingly, when the TDC pulse signal indicates the specified reference cylinder which is subject to sequential fuel injection at the present TDC pulse signal, fuel is supplied to the cylinders in the simultaneous group fuel injection mode, and then fuel is supplied to the cylinders of the other cylinder group in the simultaneous group fuel injection mode at the moment when the next TDC pulse is generated.

In this way fuel is supplied sufficiently to all the cylinders in changing the fuel injection mode from the sequential fuel injection mode to the simultaneous group fuel injection mode. Thus, the fuel injection mode is changed over smoothly by the fuel injection controller hence neither additional fuel injection nor extension of the pulse width of the control pulse is necessary, such that the fuel injection controller is simplified.

Figure 7:
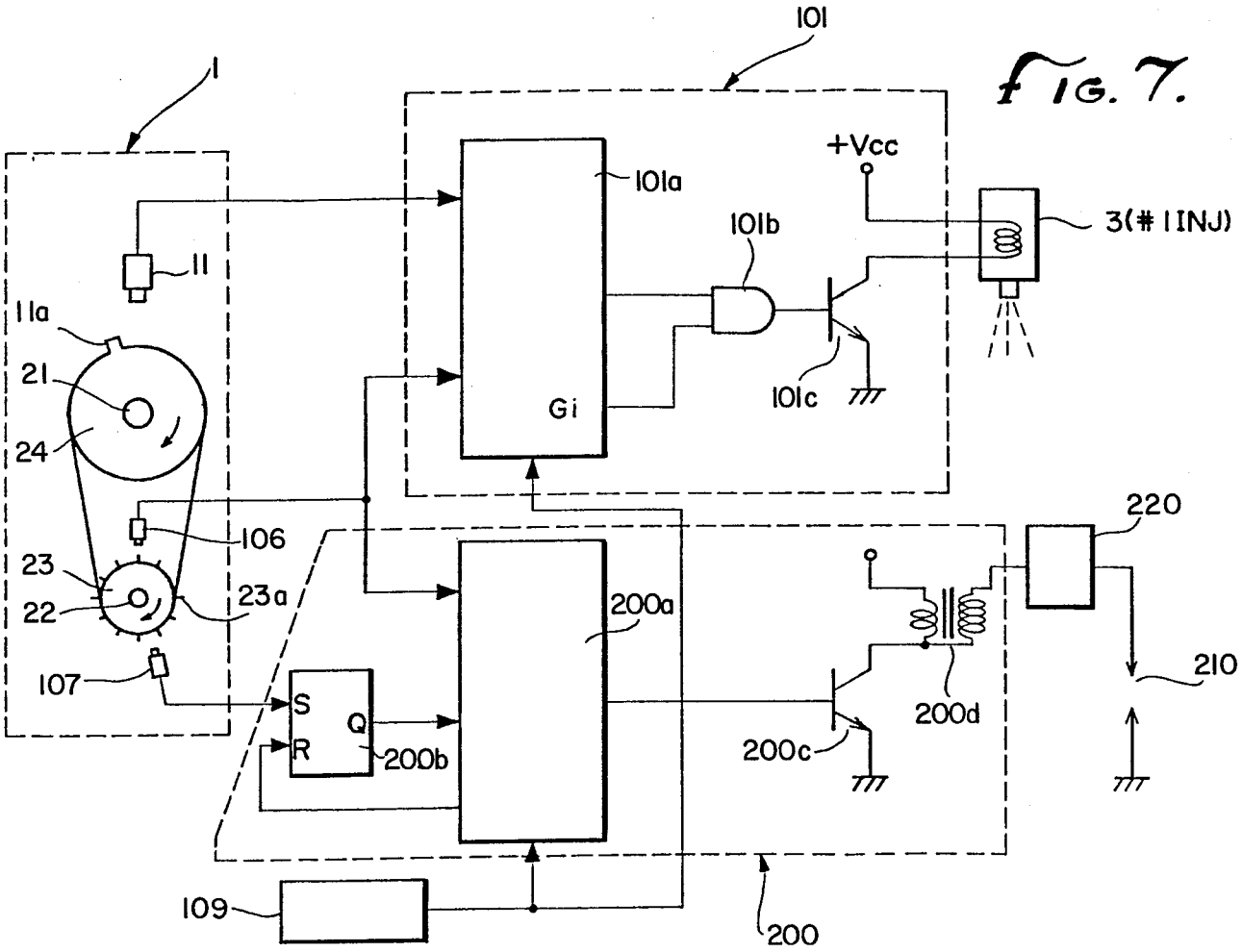
FIG. 7 is a block diagram showing the general configuration of an electronic internal-combustion engine controller in a second aspect of the present invention.

In a second aspect of the invention, as shown in FIG. 7, a six-cylinder engine 1 has a crankshaft 22 which rotates clockwise, as viewed in FIG. 7, and a camshaft 21 which rotates once every two turns of the crankshaft 22. A rotor 23 is mounted fixedly on the crankshaft 22 for rotation together therewith. A cam rotor 24 is similarly fixed on the camshaft 21. A plurality of projections (for example, eleven projections) 23*a* are arranged at regular angular intervals (for example, 30°) on a portion of the circumference of the rotor 23 excluding a portion of the circumference corresponding to the two angular intervals. A single projection 11*a* is provided at a predetermined position on the circumference of the cam rotor 24.

A PC1 sensor 106 such as a pickup, is disposed near the circular path of the projections 23*a*. A PC2 sensor 107, such as a pickup, is disposed near the circular path of the projections 23*a*. The PC2 sensor 107 is spaced apart from the PC1 sensor 106 in a clockwise direction, as viewed in FIG. 7, by a predetermined angular distance (for example, 175°). The PC1 sensor 106 and the PC2 sensor 107 each provide one pulse signal (a PC1 signal shown in FIGS. 8 and 13, and a PC2 signal shown in FIG. 13 every time each projection 23*a* passes by each of the PC1 sensor 106 and PC2 sensor 107 as the crankshaft 22 rotates clockwise.

Figure 8:
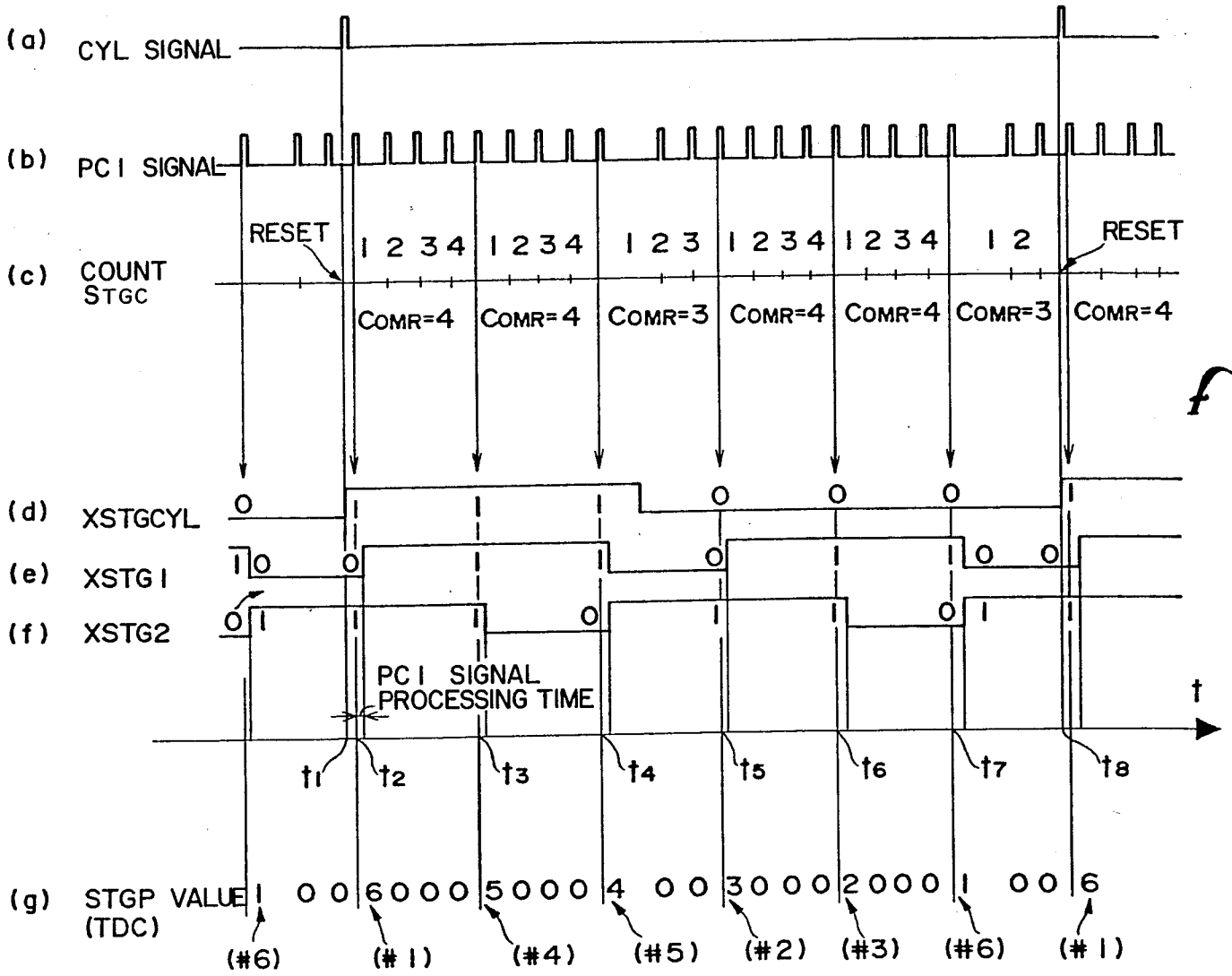
FIG. 8 is a timing chart illustrating in part routines for setting a cylinder discriminating value STGP on the basis of a CYL signal and a PC1 signal.

A cylinder discriminating sensor (hereinafter referred to as "CYL sensor") 11 such as a pickup, is disposed near the circular path of the projection 11*a*. The CYL sensor 11 generates a pulse signal indicating the TDC of a suction or intake stroke of a specified reference cylinder (a CYL signal as shown in FIG. 8) every time the projection 11*a* passes by the CYL sensor 11 as the camshaft rotates.

The PC1 signals and the CYL signals generated while the crankshaft 22 (or the camshaft 21) rotates are applied to a fuel injection timing control unit 101, which controls fuel injection timing for fuel injection valves 3 on the basis of those signals. The PC1 signals and the PC2 signals are applied to an ignition timing control unit 200, which controls ignition timing for spark plugs 210 on the basis of those signals. The fuel injection timing control unit 101 and the ignition timing control unit 200 are microcomputers.

The fuel injection timing control unit 101 essentially comprises a fuel injection angle setting circuit 101*a* which sets a fuel injection period $TF_1$ on the basis of parameter signals provided by parameter sensors 109 such as a throttle valve position sensor and an engine temperature sensor. Angle setting circuit 101*a* then gives a driving signal corresponding to the fuel injection period $T_{FI}$ to the fuel injection valves 3 (INJ1 to INJ6) of the cylinders at predetermined phases of the crankshaft 22, respectively). AND gates 101*b* receive the driving signal and open/close signals provided by the injection gates Gi (i=1 to 6) of the fuel injection period setting circuit 101*a* respectively, and allow the application of the driving signal only to the fuel injection valve 3 (for example, INJ1) of the cylinder which is at the phase for fuel injection. Driving transistors 101*c* are connected to AND gate 101*b*. Although the fuel injection valves 3, the AND gates 101*b*, the driving transistors 101*c* and the injection gates Gi are provided respectively for the cylinders, for clarity, only those for the first cylinder CYL1 are shown in FIG. 7.

The ignition timing control unit 200 comprise an ignition angle setting circuit 200*a* which selects an energizing start angle $T_{SG}$ and an energizing end angle $T_{IG}$ for each of the ignition coils 200*d* on the basis of the parameter signals given thereto by the parameter sensors 109. The control unit 200 and discriminates predetermined crank angle stages $S_{SGC}$ and $S_{IGS}$ in which count-down operations for counting down the energizing start angle $T_{SG}$ and the energizing end angle $T_{IG}$ are started, respectively, on the basis of the PC1 signal provided by the PC1 sensor 106 and the PC2 signal provided by the PC2 sensor 107. A flip-flop circuit 200*b* provides a status signal (FIG. 13(*c*) described below) on the basis of the PC1 signal and the PC2 signal. Ignition coils 200*d* and driving transistors 200*c* are similarly included. An ignition signal provided by the ignition timing control unit 200 is distributed to the spark plugs 210 of the cylinders by a known distributor 220.

The flip-flop circuit 200*b* operates on the basis of the PC1 signal provided by the PC1 sensor 106 and the PC2 signal provided by the PC2 sensor 107. It applies the status signal (FIG. 13(*c*)) through an output terminal Q to the ignition angle setting circuit 200*a*. Specifically, every time the PC2 signal (pulse signal) is applied to the set terminal S of the flip-flop circuit 200*b*, the output at the output terminal Q goes HIGH, while the output at the output terminal Q goes LOW every time the PC1 signal is applied through the ignition angle setting circuit 200*a* to the reset terminal R. As mentioned above, since the projections 23*a* are arranged at equal intervals in the portion of the circumference of the rotary member 23, a status signal, which appears at the output terminal Q of the flip-flop circuit 200*b* when the PC1 signal and the PC2 signal are applied to the flip-flop circuit 200*b* goes HIGH when the PC1 signal is applied to the reset terminal R, because the PC2 signal is applied to the set terminal S previously. However, when the portion of the circumference of the rotary member 23 not provided with the projection 23*a* passes by the PC sensor 107, no PC2 signal is generated ($t_{10}$ and $t_{12}$ in FIG. 13), and hence the status signal is held LOW even when the PC1 signal is applied to the reset terminal R of the flip-flop circuit 200*b*. Although the PC2 signals are generated regularly at equal intervals, one of the PC2 signals is omitted in one turn of the crankshaft 22. Accordingly, the status signal is held LOW even when the PC1 signal is generated once every one turn of the crankshaft. Accordingly, the stage serving as a reference to the PC1 signal can be decided on the basis of the PC1 signal and the status signal.

The manner of operation of the fuel injection angle setting circuit 101*a* based on the PC1 signals provided by the PC1 sensor 106 and the CYL provided by the CYL sensor 11, for discriminating the TDC of an intake or suction stroke in each cylinder and fuel injection which is performed subsequent to the discrimination of the TDC is described below with reference to FIGS. 8, 9 and 10.

Figure 9:
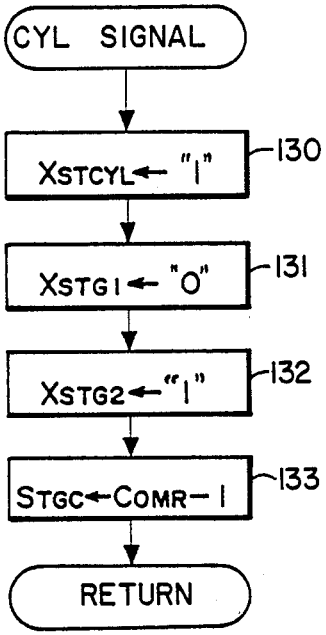
FIG. 9 is a flow chart of an initialization routine which is executed every time the CYL signal is generated.

FIG. 9 shows an initialization routine. When a CYL signal indicating the TDC of a specified reference cylinder (for example, the cylinder corresponding to the fuel injection valve INJ1) is generated, a controlled value $X_{STCYL}$ is set HIGH in Step 132, the count $S_{IGC}$ of a free-run counter is set to a value equal to a comparison count $C_{OMR}$ minus one in Step 133, and then the routine is ended.

Figure 10:
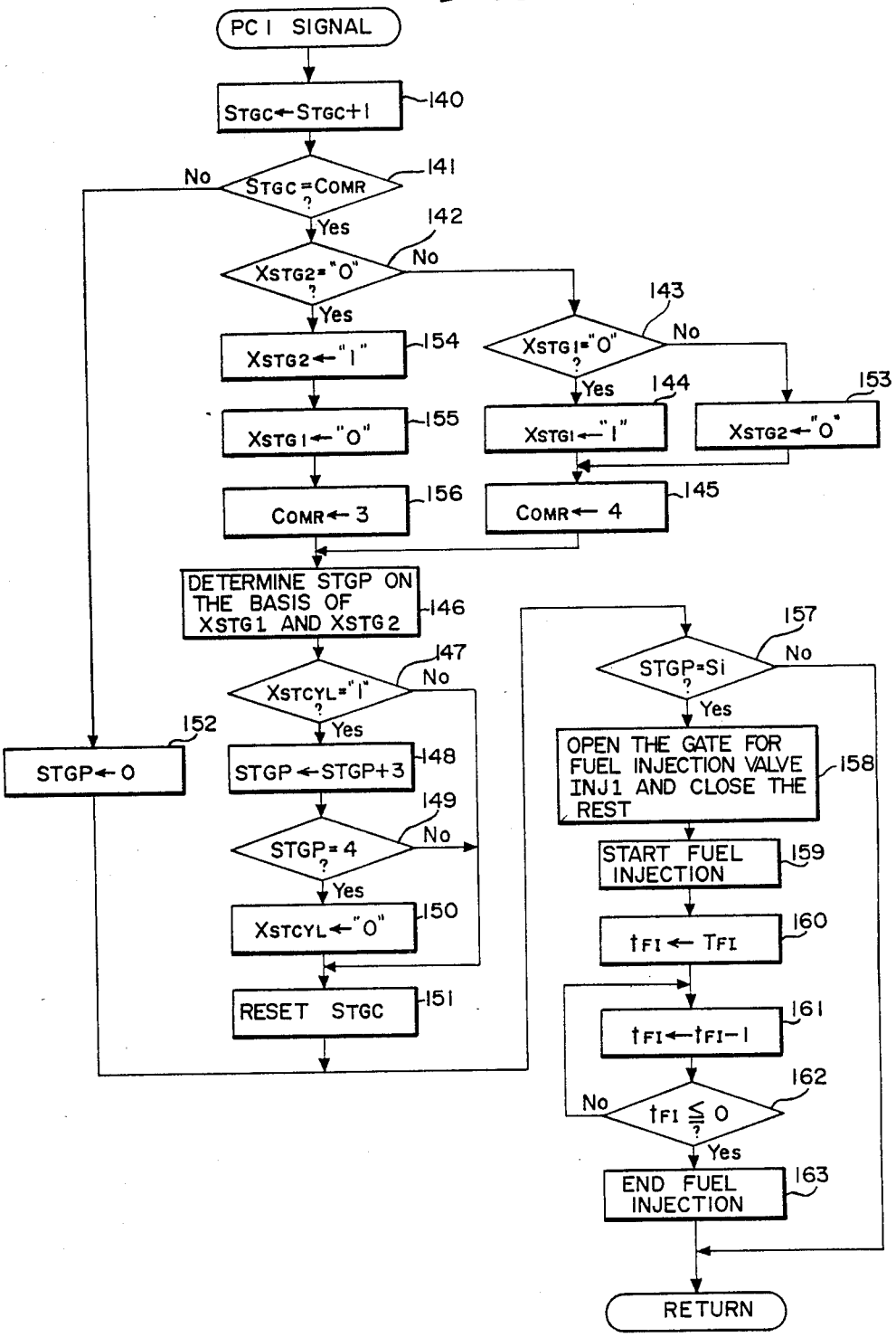
FIG. 10 is a flow chart of a routine which is executed for TDC detection and fuel injection on the basis of the CYL signal and the PC1 signal.

Consequently, the controlled values $X_{STCYL}$, $X_{STG1}$, $X_{STG2}$ and the count $S_{TGC}$ are initialized regardless of the execution of the routine shown in FIG. 10 every time the CYL signal is generated.

A control routine for TDC discrimination and fuel injection is illustrated in FIG. 10. This control routine is executed by the fuel injection angle setting circuit 101*a* ever time the PC1 signal is generated.

In the case where the PC1 signal provided in the present control loop is generated immediately after the CYL signal has been generated (at time $t_2$ in FIG. 8) in Step 140, the count $S_{TGC}$ for the present control loop is set to a value equal to the count $S_{TGC}$ at this time plus one. (FIG. 10). In Step 141, a decision is made on whether the new count $S_{TGC}$ coincides with the predetermined comparison count $C_{OMR}$ (3 or 4) set in Step 145 or 156. As mentioned above, since the count $S_{TGC}$ is set to a value equal to the comparison count $C_{OMR}$ minus one in Step 133 (FIG. 9) upon the generation of the CYL signal, the decision in Step 141 is affirmative (YES) at time $t_2$, and hence the routine goes to Step 142. In Step 142, a decision is made on whether the controlled value $X_{STG2}$ is LOW and, in Step 143, it is determined whether the controlled value $X_{STG1}$ is LOW. Since the decision in Step 142 is negative (NO) and the decision in Step 143 is YES at time $t_2$ immediately after the generation of the CYL signal ($X_{STG2}$=HIGH, $X_{STG1}$=LOW), the routine goes to Step 144 to set the controlled value $X_{STG1}$ high, the comparison count $C_{OMR}$ is set to four in Step 145, and then the routine goes to Step 146.

In Step 146, a cylinder discriminating value STGP is decided on the basis of the controlled values $X_{STG1}$ and $X_{STG2}$ at this instant. Specifically, the controlled values $X_{STG1}$ and $X_{STG2}$ are stored, for example, in the lower two bits of a 8-bit byte in the fuel injection angle setting circuit 101*a*, STGP=0 when ($X_{STG1}$, $X_{STG2}$)=(LOW, LOW), STGP=1 when ($X_{STG1}$, $X_{STG2}$)=LOW, HIGH), STGP=2 when ($X_{STG1}$, $X_{STG2}$)=(HIGH, LOW), and STGP=3 when ($X_{STG1}$, $X_{STG2}$)=(HIGH, HIGH). Accordingly, in the present control loop, ($X_{STG1}$, $S_{STG2}$)=(HIGH, HIGH), and hence STGP =3.

In Step 147, a decision is made on whether the controlled value $X_{STCYL}$ is HIGH. Since the controlled value $X_{STCYL}$= HIGH immediately after the generation of the CYL signal (Step 130 in FIG. 9), the decision in Step 147 is YES. Then, in Step 148, the STGP decided in Step 146 (STGP=3) is incremented by three to set a final STGP for the present control loop. Accordingly, STGP=6 at time $t_2$. Then, in Step 149, it is determined if STGP =4. In the present control loop, the decision in Step 149 is NO, and hence the routine skips Step 150 and goes to Step 151, in which the free-run counter is reset, and then the routine goes to Step 157.

Upon the generation of the next PC1 signal, the count $S_{TGC}$ of the free-run counter reset in Step 151 is incremented by one (Step 140), and in Step 141 it is decided if the count $S_{TGC}$ coincides with the count $C_{OMR}$=4 set in Step 145. Since the decision in Step 141 in this control loop is NO, the cylinder discriminating value STGP is set to zero in Step 152, and then the routine goes to Step 157. Steps 140, 141, 152, 157 and the following steps are repeated until the count $S_{TGC}$ coincides with the comparison count $C_{OMR}$, during which $X_{STCYL}$, $S_{STG1}$ and $X_{STG2}$ are held HIGH.

Upon the generation of the fifth PC1 signal after the CYL signal (time $t_3$ in FIG. 8), the count $S_{TGC}$ becomes 4 and the decision in Step 141 becomes YES. At this moment, since the decisions in the subsequent Steps 142 and 143 are NO, the controlled value $X_{STG2}$ goes LOW in Step 153, Step 145 is executed, and then the cylinder discriminating value STGP is determined in Step 146. In the present control loop, since $X_{STG1}$ is HIGH and $X_{STG2}$ goes LOW, the cylinder discriminating value STGP is 2. Since the controlled value $X_{STG2}$ still remains HIGH, the decision in Step 147 is YES, the cylinder discriminating value STGP, which is now 2, is incremented by 3 to set the final cylinder discriminating value STGP to 5 in Step 148, and then Step 149 is executed. The decision in Step 149 is NO also in the present control loop, Step 150 is skipped, the count $S_{TGC}$ is cleared in Step 151, and then the routine goes to Step 157. Accordingly, the cylinder discriminating value STGP=5 at time $t_3$.

The decision in Step 141 is NO until the count $S_{TGC}$ cleared in Step 151 increases up to 4, namely, until the PC1 signal is generated four times, and hence the cylinder discriminating value STGP=0, $X_{STCTL}$ remains HIGH, $X_{STG1}$ remains HIGH, and $X_{STG2}$ remains LOW.

Upon the generation of the fourth PC1 signal at time $t_4$ (FIG. 8) after the CYL signal (time $t_3$ in FIG. 8), the decision in Step 141 becomes YES, and then the decision in Step 142 becomes YES. Then, in Step 154, the controlled value $X_{STG2}$ becomes HIGH, the controlled value $X_{STG1}$ becomes LOW in Step 155, the comparison count $C_{OMR}$ is set to 3 in Step 156, and then the routine goes to Step 146.

Since $X_{STG1}$=LOW and $X_{STG2}$=HIGH in this control loop, the cylinder discriminating value STGP=1. At this moment, since $X_{STCYL}$ is still HIGH and the decision in Step 147 is YES, the cylinder discriminating value STGP (=1) is incremented by 3 in Step 148 to set a final cylinder discriminating value (=4) for the present control loop. In this case, the decision in the next Step 149 is YES, $X_{STCYL}$ goes LOW in Step 150, the count $S_{TGC}$ is cleared in Step 151, and then the routine goes to Step 157. Accordingly, STGP=4 at time $t_4$ (FIG. 8).

The decision in Step 141 remains NO until the count $S_{TGC}$ cleared in Step 151 increases up to a comparison count (=3) set in Step 156. In this case, a state in which STGP=0, $X_{STCYL}$=LOW, $X_{STG1}$=LOW and $X_{STG2}$=HIGH is maintained.

Upon the generation of the third PC1 signal at time $t_5$ (FIG. 8) after the PC1 signal generated at time $t_4$, the decision in Step 141 becomes YES. In this control loop, since $X_{STG1}$ is LOW and $X_{STG2}$ is HIGH (similar to the state at time $t_2$) Steps 142 through 146 are executed, and the cylinder discriminating value STGP becomes 3. However, since $X_{STCYL}$ is LOW in this control loop, the decision in Step 147 is NO, Steps 148, 149 and 150 are skipped, the count $S_{TGC}$ is cleared in Step 151, and then Step 157 is executed. Accordingly, STGP=3 at time $t_3$ (FIG. 8).

Thereafter, the decision in Step 141 remains NO until the count $S_{TGC}$ cleared in Step 151 increases to a comparison count $C_{OMR}$ (=4) set in Step 145. In this case, a state in which STGP=0, $X_{STCYL}$=LOW, $X_{STG1}$=HIGH and $X_{STG2}$=HIGH is maintained.

Upon the generation of the fourth PC1 signal from the PC1 signal generated at time $t_5$ (FIG. 8) at time $t_6$ (FIG. 8), the decision in Step 141 becomes YES. In this control loop, similar to the state at time $t_3$, $X_{STG1}$=HIGH and $X_{STG2}$=HIGH. Therefore, Steps 142, 143, 153, 145 and 146 are executed, and then the cylinder discriminating value STGP becomes 2. However, since $X_{STCYL}$ is LOW also in this control loop, the decision in Step 147 is no, Steps 145, 149, and 150 are skipped, the count $S_{TGC}$ is cleared in Step 151, and then Step 157 is executed. Accordingly, STGP=2 at time $t_6$ (FIG. 8).

Thereafter, the decision in Step 141 remains NO until the count $S_{TGC}$ cleared in Step 151 increases up to the $C_{OMR}$ (=4) set in Step 145. In this case, a state in which STGP=0, $X_{STCYL}$=LOW, $X_{STG1}$=HIGH and $X_{STG2}$=LOW is maintained.

Upon the generation of the fourth PC1 from the PC1 signal generated at time $t_6$ (FIG. 8) at time $t_7$, the decision in Step 141 becomes YES. In this control loop, similar to the state at time $t_4$, $X_{STG1}$=HIGH and $X_{STG2}$=LOW. Therefore, Steps 142, 154, 155, 156 and 146 are executed, and thereby the cylinder discriminating value STGP becomes 1. However, since $X_{STCYL}$=-LOW in this control loop, the decision in Step 147 is NO, Steps 148, 149 and 150 are skipped, the count $S_{TGC}$ is cleared in Step 151, and then Step 157 is executed. Accordingly, STGP=1 at time $t_7$ (FIG. 8).

Thereafter, the decision in Step 141 remains NO until the count $S_{TGC}$ cleared in Step 151 increases up to the $C_{OMR}$ (=3) set in Step 156. In this case, a state in which STGP=0, $X_{STG1}$=LOW and $X_{STG2}$=HIGH is maintained.

As shown in FIG. 8, the CYL signal is generated at time $t_8$ before the third PC1 signal from the PC1 signal generated at time $t_7$. Then, the routine shown in FIG. 9 is executed to make $X_{STYL}$ go HIGH $X_{STG1}$ go LOW $X_{STG2}$ go HIGH, and $S_{TGC}$ become $C_{OMR}-1$. Consequently, control steps executed during a time interval $t_1$ and time $t_8$ are repeated.

Thus, during a time interval between successive CYL signals, the cylinder discriminating value STGP becomes 1, 2, 3, 4, 5 and 6 sequentially for every crank angle of 180°, and a series of the cylinder discriminating values STGPs is repeated periodically every time the CYL signal is generated. Since the cylinder discriminating values STGPs 1, 2, 3, 4, 5 and 6 are assigned previously, for example, to the cylinders No. 1, No. 4, No. 5, No. 2, No. 3 and No. 6, respectively, the cylinder for which fuel is to be injected, and the fuel injection angle for the cylinder can be determined by examining the cylinder discriminating value STGP every time the CYL signal is generated.

In practice, Steps 157 to 163 for fuel injection are executed for each cylinder. The cylinder into which fuel is to be injected is hereinafter denoted by CYLi (i represents 1, 2, 3, 4, 5 or 6).

In Step 157, it is decided whether the cylinder discriminating value STGP determined by Steps 140 through 156 is Si. When the decision in Step 157 is NO, namely, when the PC1 signal in this control loop does not indicate the TDC of a suction or intake stroke of the cylinder CYL1, Steps 158 through 163 are skipped and the routine is ended.

When the decision in Step 157 is YES, the gate Gi (FIG. 7) corresponding to the cylinder CYLi is opened and the rest of the gates, not shown, are closed (step 158). Then, a driving signal for driving the fuel injection valve INJi is applied to the AND gate **101*b* in Step 159 to start fuel injection, the count of the down-counter for counting down a fuel injection period is set to a count $t_{FI}$ in Step 160 on the basis of parameter signals provided by the operation parameter sensor 109 and the down-counter is started immediately in Step 161. Then, in Step 162, a decision is made on whether the count $t_{FI}$ has decreased to zero. When the decision in Step 162 is NO, Steps 161 and 162 are repeated. When the decision in Step 162 is YES, the fuel injection valve INJi is closed in Step 163** to terminate fuel injection, and then the routine is ended.

Thus, this embodiment of the present invention surely discriminates the TDC of a suction stroke of each cylinder and controls fuel injection simply by updating the controlled variables through the execution of the foregoing routines by the fuel injection angle setting circuit **101*a***. The TDC signal directly indicating the TDC of each cylinder is not used and the CYL signals and the PC1 signal are not composed or decoded.

Ignition timing control operation to be executed by the ignition angle setting circuit on the basis of the PC1 signal provided by the PC1 sensor 106 and the PC2 signal provided by the PC2 sensor 107 are described hereinafter with reference to FIGS. 11, 12 and 13.

Figure 11:
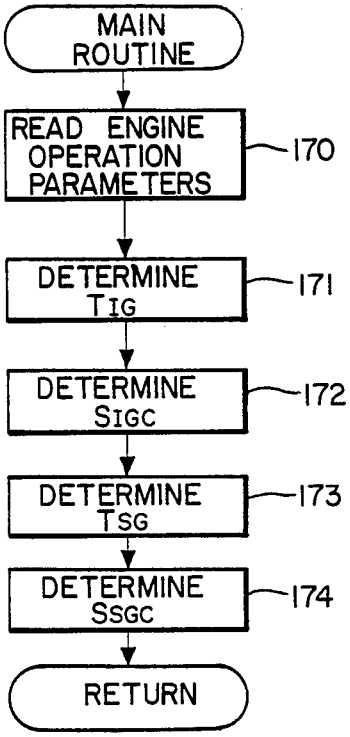
FIG. 11 is a flow chart of a routine for determining the state S of the PC1 signal and for executing ignition operation.
Figure 12:
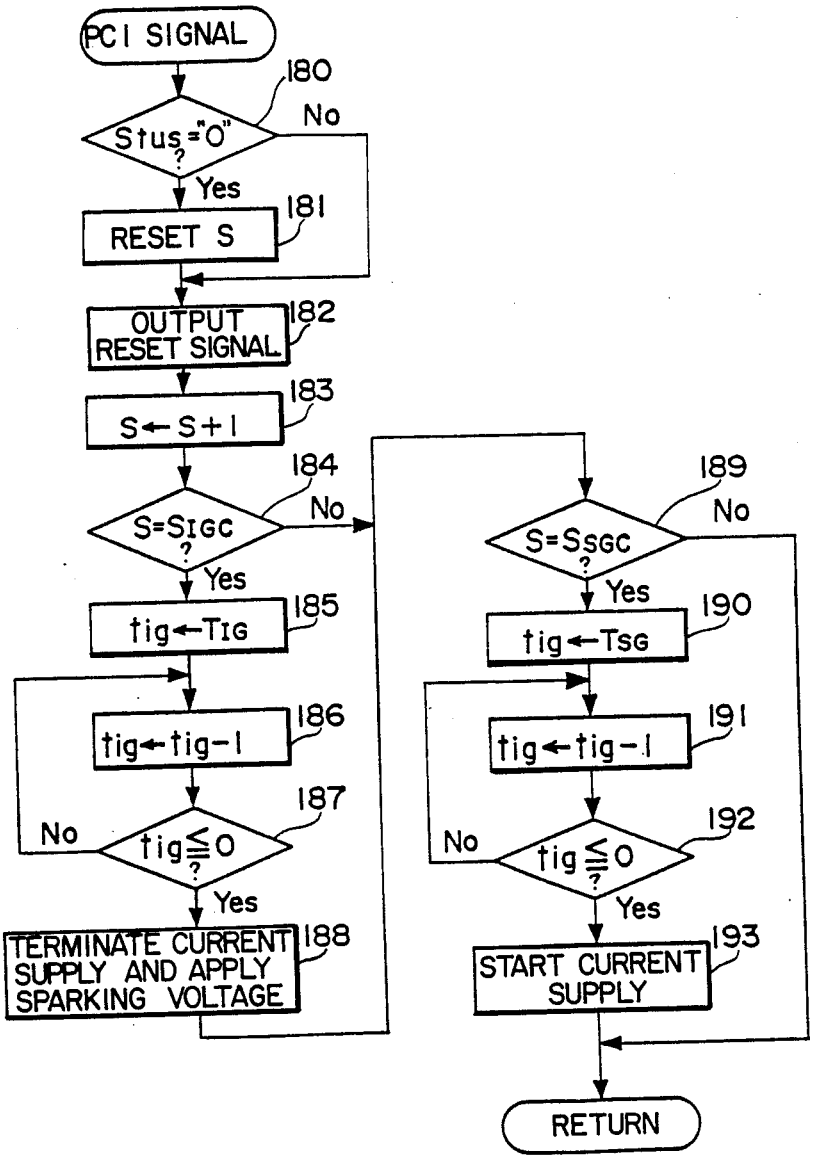
FIG. 12 is a flow chart of a routine for determining the stage S of the PC1 signal and for executing ignition operation.

FIG. 11 shows a main routine wherein output signals of the operation parameter sensor 109 are received in Step 170, and the subroutines are executed to determine a current supply start angle $T_{SG}$ in Step 171, to determine a stage $S_{SGC}$ for starting the down count of the current supply starting angle $T_{SG}$ in Step 173, and to determine a stage Ss in Step 174. A stage S for generating the PC1 signal is determined through the comparison of the PC1 signal and a Stus signal (FIG. 13(*d*)) provided by the flip-flop circuit **200*b*** on the basis of the PC1 signal and the PC2 signal.

The procedure for setting the stage for the PC1 signal, and procedure for ignition are described hereinafter with reference to FIG. 12 which showed a routine executed by the ignition angle setting circuit **200*a* every time the PC1 signal is generated. The stage S is set by executing Steps 180 and 183. In Step 180, a decision is made on whether the Stus signal, namely, the output of the flip-flop circuit 200*b*, is LOW. When the decision in Step 180 is YES, the value of the stage S is cleared to zero in Step 181, the PC1 signal is applied to the reset input terminal of the flip-flop circuit 200*b* in Step 182, and then the value (=0) of the stage S is incremented by 1 to determine a stage S for this PC1 signal in Step 183. Accordingly, a time interval from the PC1 signal generated at time $t_{10}$ (FIG. 13**) to time $t_{11}$ where the next PC1 signal is generated is a state 1, in which state S=1.

Since the Stus signal provided upon the generation of the PC1 signal remains HIGH until the PC1 signal is generated at time $t_{12}$ (FIG. 13), the decision in Step 180 remains NO and the value of the stage S is incremented by 1 every time the PC1 signal is generated. Since the PC2 signal immediately before the PC1 signal at time $t_{12}$ is missing, the Stus signal at the output terminal Q of the flip-flop circuit **200*b* remains LOW when the PC1 signal is generated at time t1z (FIG. 13**), the decision in Step 180 is YES again and hence the value S is set to 0. Consequently, the value of the stage S becomes 1, 2, 3, . . . , 10, 1, 1 2, . . . sequentially.

Steps 184 to 193 describe the ignition procedure. In Step 184, it is determined whether the stage S set in Step 183 coincides with the stage $S_{IGC}$ (4, 7 or 11 in FIG. 13) determined in Step 172 (FIG. 11).

When the decision in Step 184 is YES, in Step 185, the count $T_{IG}$ determined in Step 171 (FIG. 11), the count $t_{IG}$ is decremented by 1 in Step 186, and a decision is made in Step 187 whether $t_{IG}$ has decreased to 0. When the decision in Step 187 is NO, Step 186 is executed again. Steps 186 and 187 are repeated until the count $t_{IG}$ reaches 0. When the decision in Step 187 is YES, the ignition angle setting circuit **200*a* terminates supplying current to the ignition coil 200*d* and applies a sparking voltage to the ignition plug 210 in Step 188**.

On the other hand, when the decision is Step 184 is NO, the routine goes to Step 189, where it is determined whether the stage S coincides with the stage $S_{SG}$ (2, 6 or 9 in FIG. 13) determined in Step 174 (FIG. 11).

When the decision in Step 189 is YES, in Step 190, the count $t_{IG}$ of a down counter which starts to count down from the stage $S_{SG}$ is set to the current supply ending angle $T_{SG}$ determined in Step 173 (FIG. 11), the count ts is decreased by 1 in Step 191, and then a decision is made in Step 192 as to whether the count $t_{IG}$ is 0.

When the decision in Step 192 is NO, Step 191 is executed again. When the decision in Step 192 is YES, namely, when $t_{IG}=0$, the ignition angle setting circuit 200*a* starts supplying current to the ignition coil 200*d* in Step 193. When both the decisions in Steps 184 and 189 are NO, the routine is ended without executing Step 188 for terminating current supplying to the ignition coil 200*d* and Step 193 for starting current supply to the ignition coil 200*d*.

Figure 13:
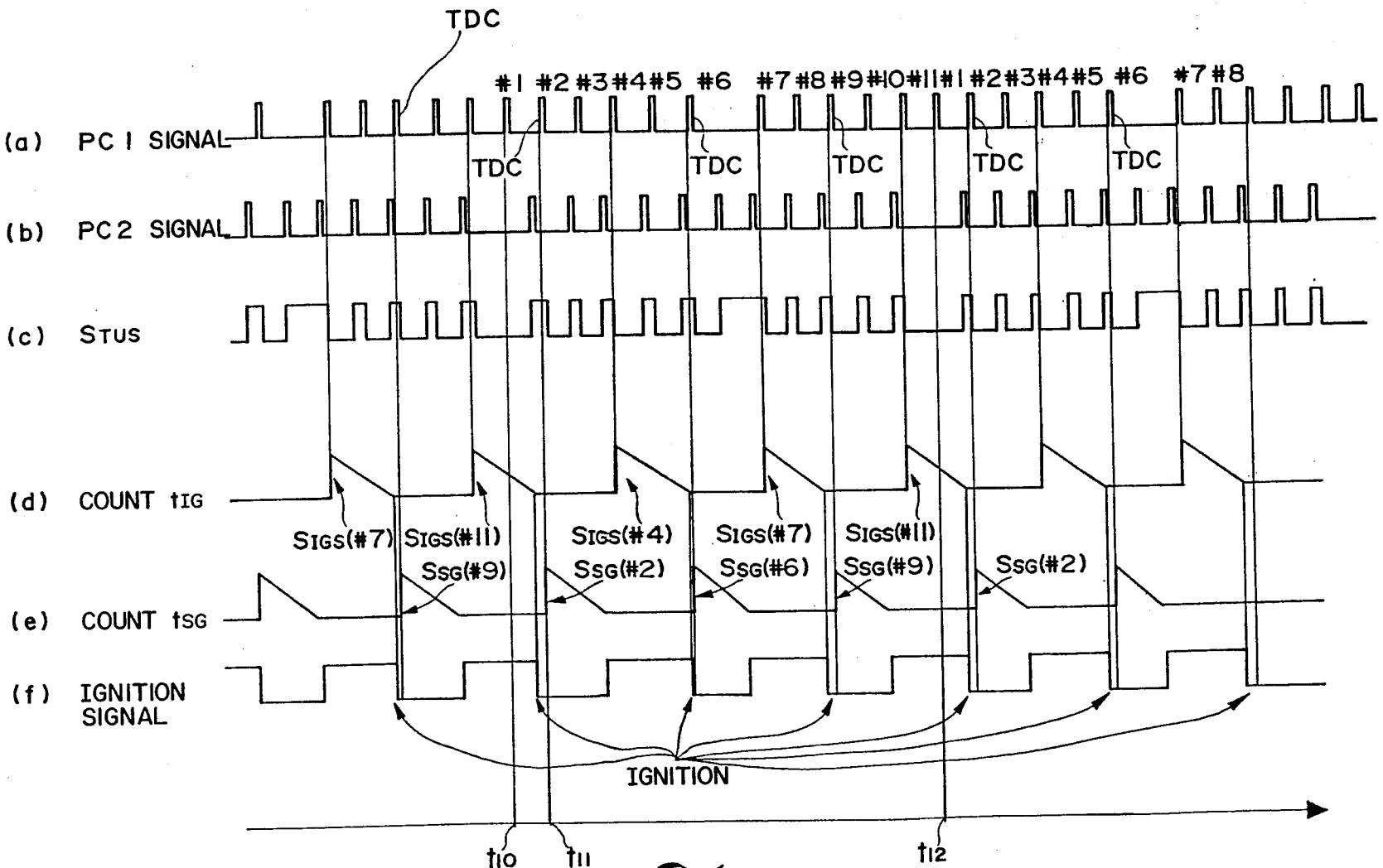
FIG. 13 is a timing chart showing the mode of generation of ignition signals obtained through the execution of the routines shown in FIGS. 11 and 12.

Thus, the routine is executed every time the PC1 signal is generated to supply current to the ignition coils 200*d* in a mode represented by a pulse signal (f) shown in FIG. 13. Consequently, a sparking voltage is generated for every rotation of the crankshaft through an angle 120°, namely, at every TDC of a compression stroke of each cylinder, and the sparking voltage is distributed by the distributor 220 to the cylinder at the TDC of a compression stroke.

Thus, the present internal-combustion engine controller has a simple crank angle detecting system for controlling fuel injection timing and ignition timing, which provides for compact construction and reduced manufacturing cost.

While embodiments of the invention have been shown and described, it would be apparent to those skilled in the art that many modifications are possible without departing from the inventive concepts disclosed herein. The invention is therefore not to be restricted except in the spirit of the appended claims.

What is claimed is:

1. A fuel injection controller for an internal-combustion engine having a crankshaft, a plurality of cylinders divided into two cylinder groups and a plurality of fuel injection units respectively for the plurality of cylinders comprising:

control pulse generating means for generating a pulse every time the crankshaft turns through a predetermined angle;

fuel injection mode of a primary fuel injection changeover means for changing over the fuel injection mode of the fuel injection units between a sequential fuel injection mode in which the fuel injection units inject fuel sequentially and independently into corresponding cylinders in synchronism with each intake process of the cylinders and a simultaneous group fuel injection mode in which the fuel injection units for the cylinders of one cylinder group of the two cylinder groups inject fuel simultaneously into the corresponding cylinders in synchronism with the control pulses and the fuel injection units for the cylinders of the other cylinder group inject fuel simultaneously into the corresponding cylinders in synchronism with the control pulses;

operating condition discriminating means for determining if the internal-combustion engine is operating in a predetermined operating condition, when a control pulse indicating the specified reference cylinder among the cylinders is generated;

wherein the fuel injection mode changeover means makes the fuel injection units for one cylinder group including the specified reference cylinder of the two cylinder groups inject fuel simultaneously upon the decision of the operating condition discriminating means that the internal-combustion engine is in the predetermined operating condition, and then makes the fuel injection units for the other cylinder group inject fuel simultaneously in synchronism with a subsequent control pulse.

2. An internal-combustion engine controller comprising:

a plurality of projections arranged at equal angular intervals on the circumference of a crankshaft of a internal-combustion engine having a fuel injection device, excluding at least a portion of the circumference of the crankshaft corresponding to the two equal angular intervals of the projections;

first pulse generating means for generating a pulse signal every time each projection passes by a fixed position as the crankshaft rotates;

second pulse generating means for generating a pulse signal having a phase angle from the pulse signal generated by the first pulse generating means;

a single projection provided on the circumference of a second shaft which rotates a rotating speed equal to one-half the rotating speed of the crankshaft;

third pulse generating means for generating a pulse signal every time the projection provided on the circumference of the second shaft passes a fixed position;

ignition timing means for controlling ignition timing for the internal-combustion engine on the basis of the pulse signals generated by the first and second pulse generating means; and fuel injection timing means for controlling the fuel injection device for appropriate fuel injection on the basis of the pulse signals generated by the first and third pulse generating means.

3. A fuel injection controller for an internal-combustion engine according to claim 1, wherein when in the sequential injection mode, the injection units inject fuel for each cylinder of two cylinder groups alternately in response to each pulse of said control pulse generating means, and when in the simultaneous group fuel injection mode, the injection units inject fuel for one group of the cylinders when the control pulse indicates the specified reference cylinder, and inject the other group of the cylinders when the control pulse indicates the next pulse to the specified reference cylinders.

4. The controller of claim 1 wherein the engine has more than three cylinders and further comprising two fuel injection pulse counters.

5. A fuel injection controller for an internal-combustion engine having a crankshaft, a plurality of cylinders divided into two cylinder groups and a plurality of fuel injection units respectively for the plurality of cylinders comprising:

control pulse generating means for generating a pulse every time the crankshaft turns through a predetermined angle;

fuel injection mode changeover means for changing over the fuel injection mode of the fuel injection units between a sequential fuel injection mode in which the fuel injection units inject fuel sequentially into corresponding cylinders in synchronism with control pulses and a simultaneous group fuel injection mode in which the fuel injection units for the cylinders of one cylinder group of the two cylinder groups inject fuel simultaneously into the corresponding cylinders in synchronism with the control pulses and the fuel injection units for the cylinders of the other cylinder group inject fuel simultaneously into the corresponding cylinders in synchronism with the control pulses;

operating condition discriminating means for determining if the internal-combustion engine is operating in a predetermined operating condition, when a control pulse indicating the specified reference cylinder among the cylinders is generated;

wherein a sequential injection is injected in synchronism with an intake process of each cylinder and is independent of each cylinder and wherein the fuel injection mode changeover means makes the fuel injection units for one cylinder group including the specified reference cylinder of the two cylinder groups inject fuel simultaneously upon the decision of the operating condition discriminating means that the internal-combustion engine is in the predetermined operating condition, and then makes the fuel injection units for the other cylinder group inject fuel simultaneously in synchronism with a subsequent control pulse.

* * * * *